US007370581B2

(12) United States Patent
Plasswich et al.

(10) Patent No.: US 7,370,581 B2
(45) Date of Patent: May 13, 2008

(54) CHANGING STATION FOR PRINTING PRESS SLEEVES

(75) Inventors: Franz Plasswich, Bremen (DE); Robert Blom, Tecklenburg (DE)

(73) Assignee: Windmoeller & Hoelscher KG, Lengerich (DE)

( * ) Notice: Subject to any disclaimer, the term of this patent is extended or adjusted under 35 U.S.C. 154(b) by 144 days.

(21) Appl. No.: 10/506,686

(22) PCT Filed: May 9, 2003

(86) PCT No.: PCT/EP03/04950

§ 371 (c)(1),
(2), (4) Date: Sep. 20, 2004

(87) PCT Pub. No.: WO03/099565

PCT Pub. Date: Dec. 4, 2003

(65) Prior Publication Data

US 2005/0139109 A1 Jun. 30, 2005

(30) Foreign Application Priority Data

May 25, 2002 (DE) ..... 102 23 414

(51) Int. Cl.
*B41L 47/16* (2006.01)
*B41F 5/00* (2006.01)

(52) U.S. Cl. ..... 101/477; 101/216; 414/331.14

(58) Field of Classification Search ..... 101/477, 101/216, 217, 375, 376, 479, 480, 485; 414/331.14, 414/495, 331.11, 608, 331.02, 331.04, 331.08
See application file for complete search history.

(56) References Cited

U.S. PATENT DOCUMENTS

| | | | | |
|---|---|---|---|---|
| 3,877,370 | A * | 4/1975 | Hantscho | 101/216 |
| 4,823,693 | A | 4/1989 | Köbler | 101/218 |
| 5,188,027 | A * | 2/1993 | Fantoni | 101/216 |
| 5,715,749 | A * | 2/1998 | Miller | 101/216 |
| 6,463,648 | B2 * | 10/2002 | Gottling et al. | 29/426.1 |
| 2002/0129720 | A1 | 9/2002 | Jendroska et al. | 101/216 |
| 2005/0257705 | A1 * | 11/2005 | Petersen et al. | 101/216 |
| 2005/0263023 | A1 * | 12/2005 | Gottling et al. | 101/477 |
| 2007/0181017 | A1 * | 8/2007 | Blanchard et al. | 101/216 |

FOREIGN PATENT DOCUMENTS

| | | |
|---|---|---|
| DE | 37 02 889 | 8/1988 |
| DE | 195 00 729 | 7/1996 |
| DE | 101 12 522 | 9/2002 |

* cited by examiner

*Primary Examiner*—Leslie J. Evanisko
(74) *Attorney, Agent, or Firm*—Jacobson Holman PLLC

(57) ABSTRACT

A changing station for sleeves of a printing machine has a conveyable magazine with at least one take-up device for the sleeves. The magazine is both vertically and horizontally conveyable alongside the printing machine. The horizontal movement can be provided by a rail, and the vertical movement can be provided by a crane or hoist.

9 Claims, 4 Drawing Sheets

CHANGING STATION FOR PRINTING PRESS SLEEVES

This is a nationalization of PCT/EP03/04950 filed May 9, 2003 and published in German.

BACKGROUND OF THE INVENTION

1. Field of the Invention

The invention concerns a changing station for sleeves of printing machines.

2. Description of the Prior Art

It is often necessary to change the print impression subjects on the printing rollers in order to implement print job orders. In order to be able to carry out a job order change as quickly and simply as possible, only the so-called printing sleeves that carry the subjects of the print impression are changed.

The as yet unpublished patent application DE 101 12 522 shows a take-up device with a plurality of carrier bars for receiving printing sleeves. This take-up device is set up in the proximity of a printing group. For this purpose, it possesses wheels, by which it is movable over the floors of the machine hall. Also, in order to set up the take-up device at an appropriate distance away from the more highly situated printing groups, the take-up device can be positioned on a lifting platform positioned alongside the printing machine. Removed sleeves are manually pulled off from the printing roller and/or from the anilox roller by the operating personnel, are lifted over to the take-up device and are slid onto a carrier bar of the take-up device. As a rule, the take-up device also carries the sleeves for the new print job order, which are also manually moved and pulled on to the printing roller and/or the anilox roller. In the case of the described operations, the operating personnel stands on the aforementioned lifting platform and lifts the sleeves to be changed from the printing machine to the take-up device and vice versa.

This work obviously made hard by the weight of the sleeves and the necessity of pulling up the bar to be changed up to the printing cylinder or up to the carrier bar is often rendered even more difficult when the position of the sleeve to be changed in the take-up device is greatly offset in terms of the axis of the printing roller or of the anilox roller.

SUMMARY OF THE INVENTION

The task of the current invention consists in facilitating this operation.

The task is achieved by the characteristic features of the invention described herein, in which an additional conveyance option is provided for a magazine in the horizontal direction, which ensures that the magazine is conveyable on both a horizontal and a vertical plane alongside the printing machine. In this case, a magazine in accordance with the invention can also simply comprise a take-up device. A take-up device can comprise a carrier bar but also of a shelf-like or drawer-shaped repository or of other types of structural elements suitable for the storage of sleeves.

The horizontal displacement capability of the magazine can be advantageously achieved by one or several crane-like devices, whereby steering of the magazine from several crane cables introduces the possibility of tipping over the magazine. Advantage can be taken from this possibility when several take-up devices of the magazine are to be simultaneously aligned with several rollers. If the axes of these rollers do not lie on one horizontal plane, the possibility of tipping over the magazine can be very useful. Of course, to realize this possibility, devices other than the setup of several cranes also come under consideration.

The horizontal displacement capability can advantageously be secured by the aid of linear guidance. When combining the devices mentioned above to realize the capability of displacement, it is recommended to use the crane and track system presented in the description of the invention.

In the case of magazines with several take-up devices, supplementary means are useful to change the position of at least one take-up device inside of the magazine. With the aid thereof, a "fine adjustment" of the position of the take-up device can be made relative to the axis of a roller without requiring that the entire magazine be moved. In the claims and in the description of the invention subject matter, various possibilities for realizing this fine adjustment are disclosed. First, a revolving magazine based on a disc is claimed, said revolving magazine rotating the take-up devices around a rotational center. A similar underlying principle consists in an endless belt or in a chain belt that runs circularly in the magazine and hereby leads the take-up devices on with itself. Also, devices that are based on a shaft-like or shelf-like organization system and that remind us in their function of the conventional cigarette machines can be advantageously applied in the framework depicted.

Of all the means for changing the position of at least one of the take-up devices in the magazine, it is a great advantage if at least two take-up devices can be set up in the same position, one behind the other. If this possibility exists, an empty take-up device can first be brought into a favorable position relative to a roller axis for the purpose of exchanging the sleeves. This take-up device can then be loaded with the sleeve used in the preceding printing process and then be brought into another position. The very take-up device carrying the "new" sleeve to be applied in the printing machine will then assume the favorable position relative to the roller axis.

Another advantageous characteristic lies in the spacing distance that separates the take-up devices from one another. If, for example, the anilox roller sleeve as well as the printing roller sleeve of an inking unit must be changed simultaneously to save time, then the spacing of the take-up device assigned to the two rollers should correspond to the mutual spacing between the rollers so that the position favorable for changing the two rollers can be "simultaneously" attained. No subsequent additional adjustment of the magazine or of the take-up devices in the magazine is then required.

As initially stated, the changing operation to be performed by the operating personnel will be facilitated by any improvement in the alignment of the take-up devices relative to the anilox or printing rollers. When the alignment of the take-up devices is especially good, the sleeve can be directly moved over from the roller onto the take-up device, whereby the sleeve is always carried together either by the take-up device, the roller or by both of the two structural elements. To this end, it is necessary that the spacing between the free end of the take-up device and the free end of the roller or of its shaft be smaller than the axial length of the sleeve.

To facilitate the realization of this form of embodiment, drawer-like slide-in units (i.e., inserts) can also be provided to extend the loading surface of the take-up devices. When changing the sleeves, these slide-in units can extend the take-up device in the direction of the free end of the rollers and, in this manner, they can carry the sleeve during sleeve change so that the operating personnel has less burdensome work to do. When applying carrier bars as take-up devices, these slide-in units, as a rule, comprise tubes that can be pulled out of the carrier bars when needed. This special form of embodiment is also more specifically detailed in the description of the subject matter.

In particular, with the use of carrier bars as take-up devices, it is advantageous if the axis of the printing roller is indeed actually in alignment with the axis of the associated carrier bar. Then the spacing distance between the end of the carrier bar and the free end of the associated roller can be extremely reduced during the changing operation. The sleeve then only needs to be pulled over from the roller onto the bar or from the bar on to the roller.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
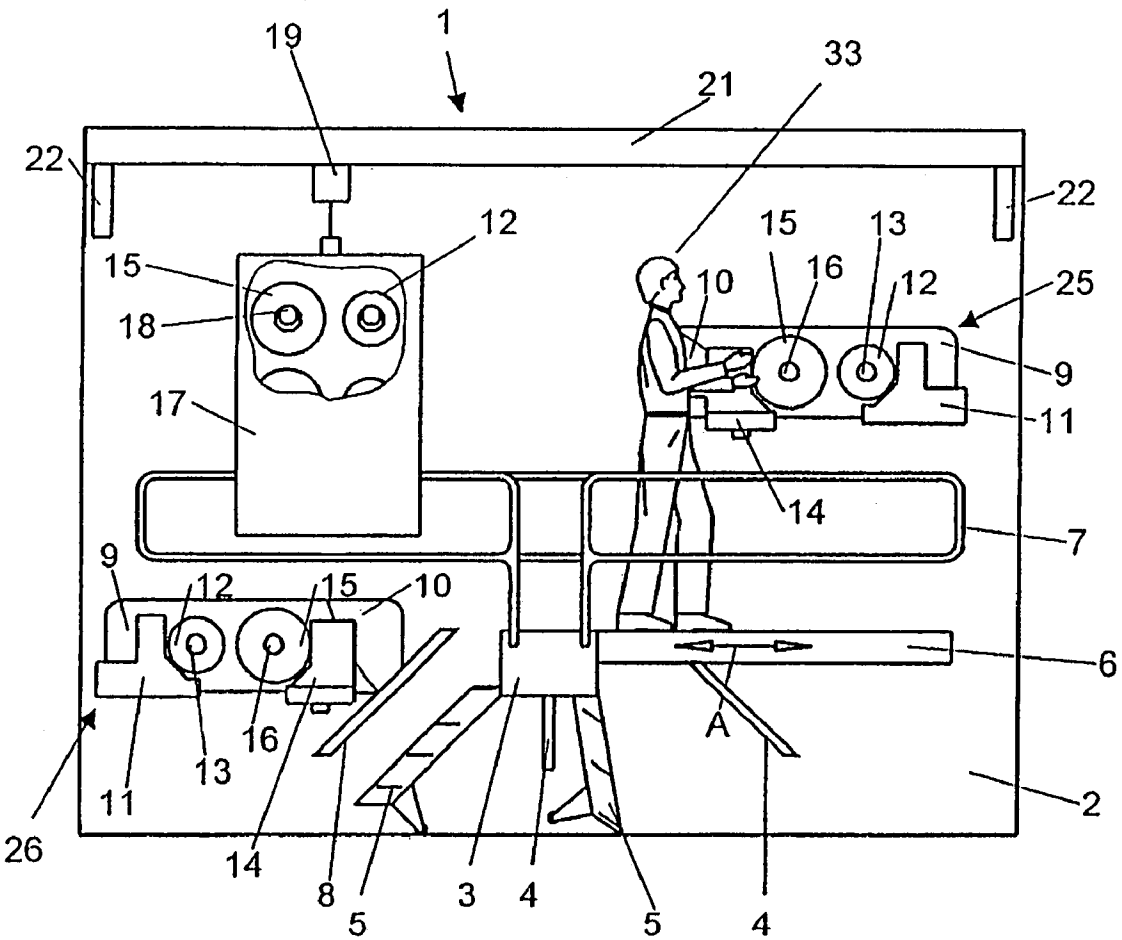
FIG. 1 A side view of a printing machine

FIG. 1 shows a printing machine 1 in which two inking units 25, 26 are represented that are made visible by the cutouts 9 in the side stand 2. Essential component parts of an inking unit are the anilox roller 13 and the printing roller 16, which are respectively supported on the bearing block 11 for anilox rollers or on the bearing block 14 for printing rollers over an underprop bearing 23, 24. Through the lower cutout 9, a section of the counter-pressure cylinder 10 can also be seen.

When changing an anilox roller sleeve 12 or a printing roller sleeve 15 in the upper area of the printing machine 1, the checker plate for footboard 6 is first pulled out by hand in the direction of arrow A so as to be subsequently positioned beneath the printing group to be accessed. For this purpose, the footboard 6 is slidably supported in the platform 3. For reasons of stability, the platform 3 is additionally supported by a support 4 on the side stand 2. On the side opposite where the footboard 6 is positioned, steps 5 fold out. The operating personnel can now access one of the upper inking units 25 via the steps 5 and the footboard 6. In order to facilitate the climb, step railings 8 are secured on the side stand 2. Falling from the footboard 6 is prevented by a side railing 7.

If the inking unit to be accessed is located in the lower area of the printing machine, then the footboard 6 and the steps 5 will create an obstruction. The footboard 6 can be moved to the side respectively opposite the counter-pressure cylinder and the steps 5 can be folded in their vertical resting position. The printing group is now openly accessible.

Figure 3:
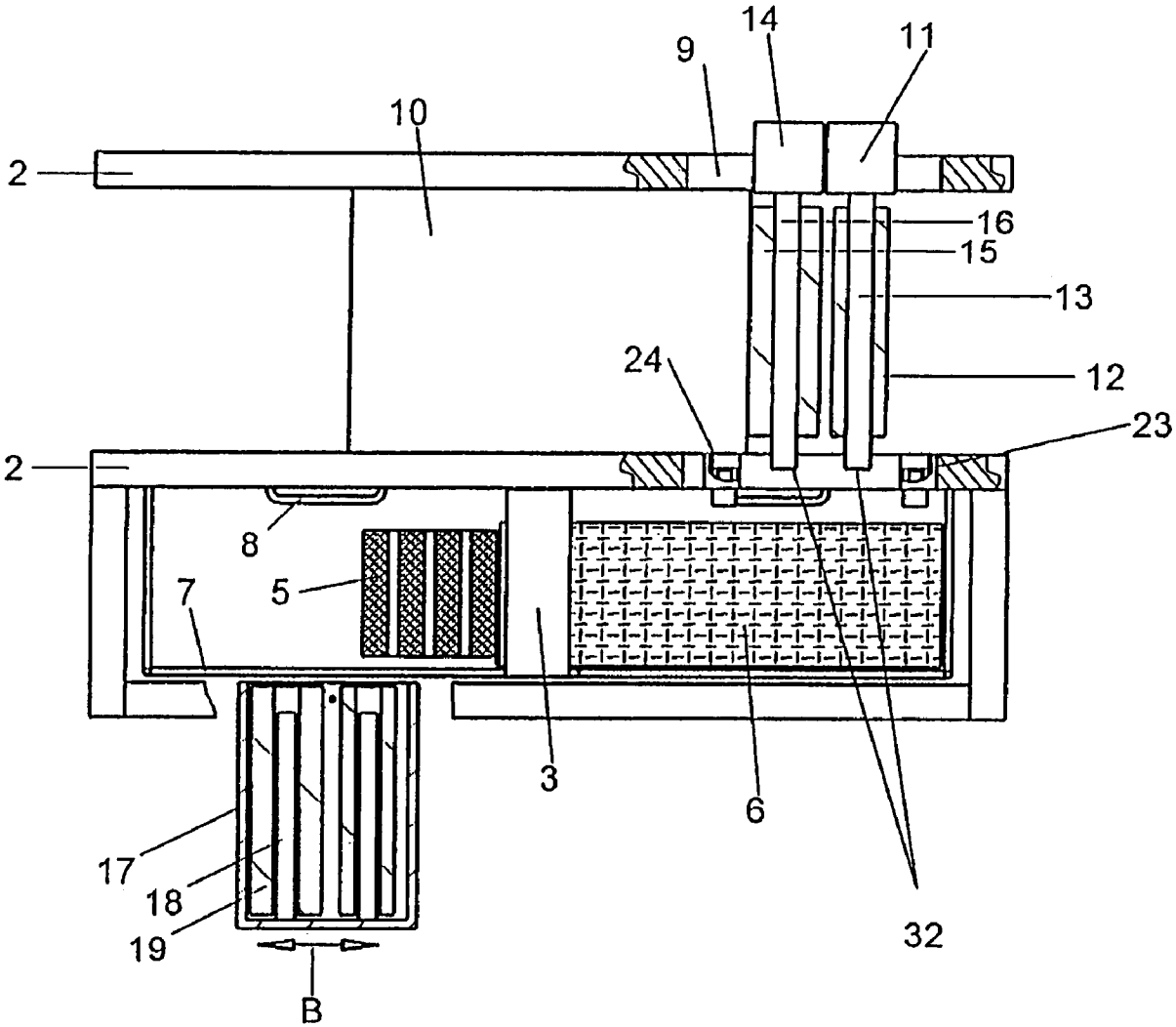
FIG. 3 A top view of the printing machine from FIG. 1

The steps necessary to carry out the sleeve change procedure are easy to recognize in FIG. 3. After opening the front face underprop bearings 23, 24, the bearing blocks 11, 14 can be slid to the side so that the printing roller sleeve 15 and/or the anilox roller sleeve 12, which are slipped on to the printing roller 16 or on to the anilox roller 13 can be accessed. The sleeves 15, 12 can now be removed by hand from the rollers 13, 16.

For transporting away the sleeves 12, 15, a magazine 17 with carrier bars 18 for sleeves 12, 15, which magazine 17 can be equipped with casters for conveyance, which are not represented here, is lifted by the aid of a crane 19. This crane 19 essentially comprises of a winding drum and of a motor. On a sliding carriage, the crane 19 is movable along the runway rail 21 running parallel to the side stand, whereby the displacement of the take-up devices 18 is ensured in the horizontal direction (x). In the shown exemplary embodiment, the magazine 17, which is closed on three sides and open on one side, is secured to the crane in such a manner that the carrier bars 18 run parallel to the rollers 13, 16 and the open side of the magazine 17 faces the printing machine 1, as is represented in FIG. 3. As mentioned, the hoist 19 gliding along the runway rail 21 and, together with it, the magazine 17 are movable in the direction of the double arrow B, in horizontal direction (x) parallel to the side stand 2. With a favorable positioning of the magazine 17, the operating personnel 33 only need move the sleeves 12, 15 over extremely short distances.

In order to do away with repositioning the entire magazine 17 when new sleeves 12, 15 are to be slipped on to the printing rollers 16 or on to the anilox rollers 13 during one same work operation, the magazine 17 can be equipped with carrier bars 18 exhibiting the same spacing distance as the axes of the two cylinders 13, 16 when in the mutually removed state.

Figure 7:
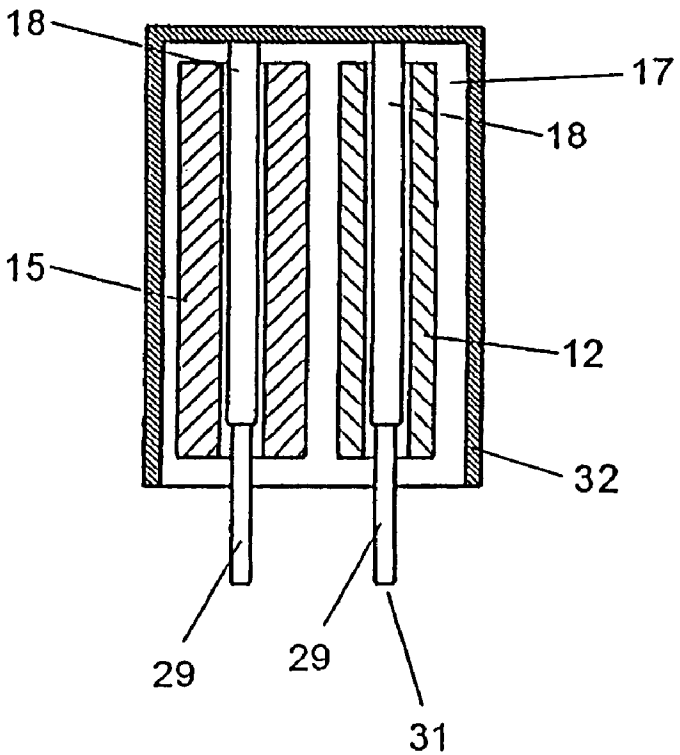
FIG. 7 A section through the magazine represented in FIG. 6
Figure 6:
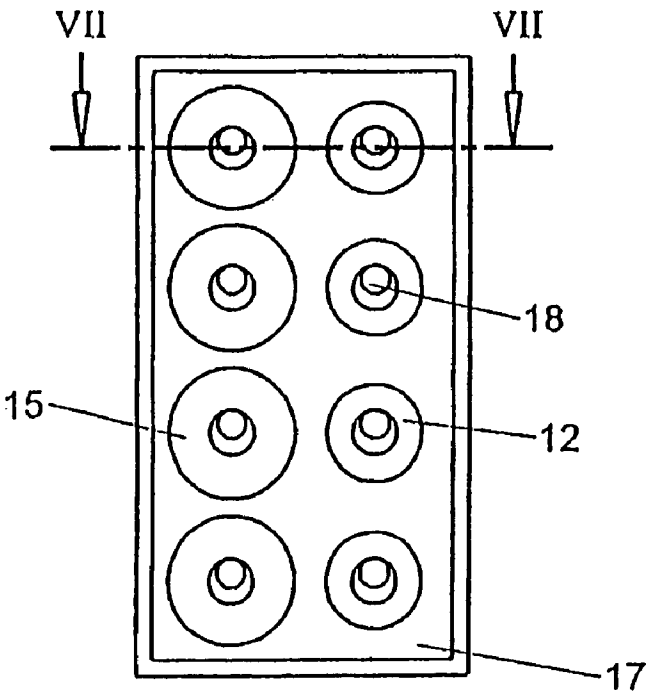
FIG. 6 A view of the open side of another magazine for sleeves

FIGS. 6 and 7 show the exemplary embodiment of the magazine 17 in a detailed version. This exemplary embodiment is also shown in FIGS. 1 and 3.

This magazine 17 comprises a case 32 that is only open on the one side, in which the carrier bars 18 are aligned in rows, in a matrix formation, to receive the sleeves 12, 15. The spacing distance between the two carrier bars 18 on a (horizontal) line corresponds to the spacing distance between the axes of the inking rollers 16 and printing rollers 13 of an inking unit 25, 26.

When changing the sleeves, the entire magazine 17 is positioned by the aid of a crane 19 and of the rails 21 in such a manner that the axes of the above-mentioned rollers 13, 16 of an inking unit 25, 26 are aligned on one plane with the associated empty carrier bars 18. The sleeves are slipped over onto the carrier bars. After this, the vertical position of the entire magazine 17 is changed with the crane so that the two carrier bars with the new sleeves 12, 15 to be installed into the inking unit are aligned with the axes of the two aforementioned rollers. After this, the rollers are fitted with these sleeves. FIG. 6 shows a section that clarifies the function of the inserts 29. These have been specifically conceived for carrying the sleeves during the sleeve changing operation. During sleeve change when the insert 29 is extended out, the free end 31 of the sleeve take-up device 18 is moved in the direction of the rollers 16, 13 or of their shafts.

Figure 2:
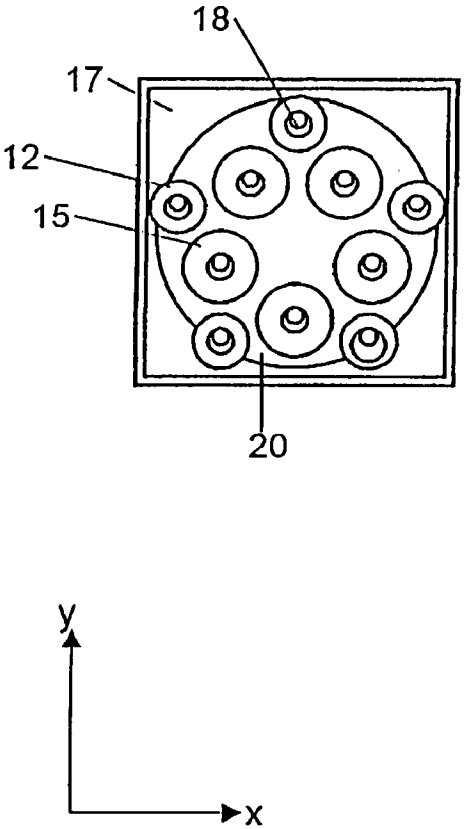
FIG. 2 A view of the open side of a magazine for sleeves
Figure 5:
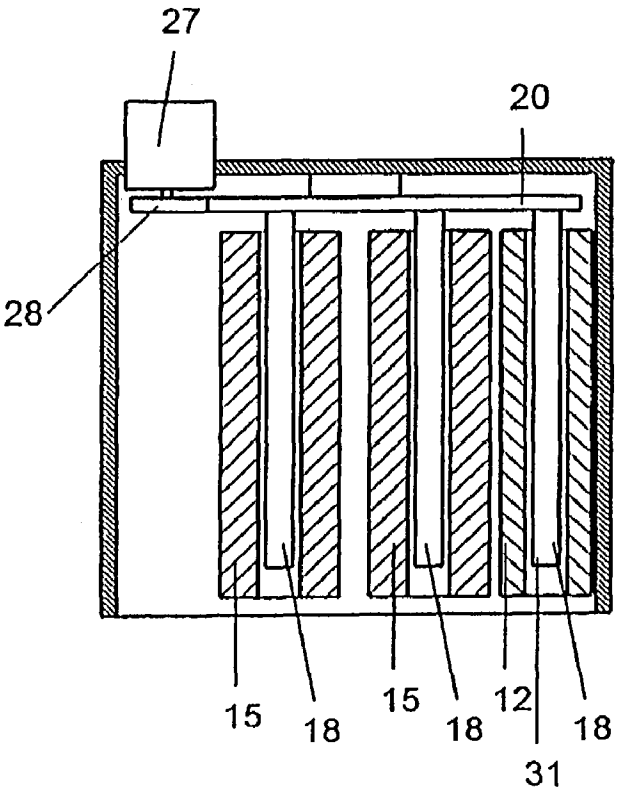
FIG. 5 A section through the magazine represented in FIG. 4
Figure 4:
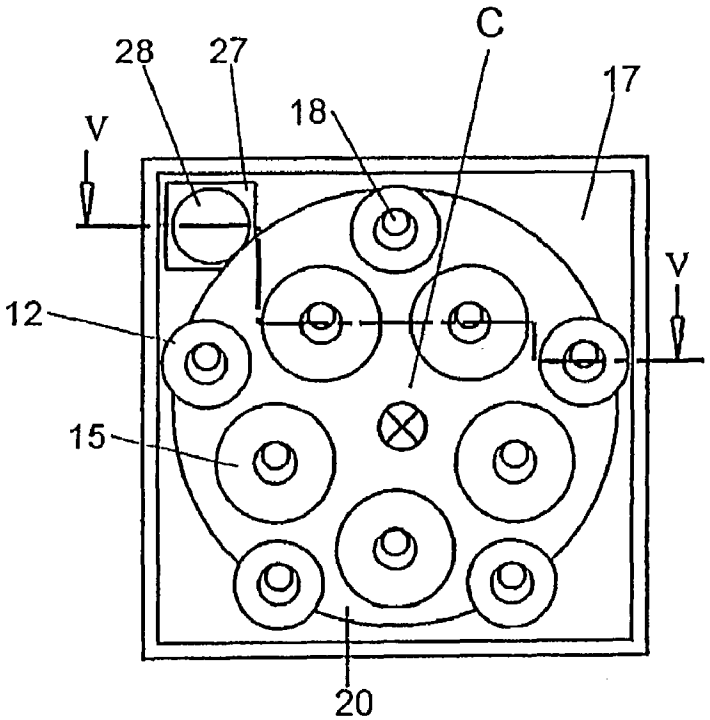
FIG. 4 A view of the open side of a magazine for sleeves

FIGS. 2, 4 and 5 show another magazine 17 that can be applied in a sleeve changing device in accordance with the invention.

This magazine contains means by which the position of the take-up devices in the magazine 17 can be changed—said take-up devices here also being carrier bars 18. These means essentially comprise a rotating disc 20, onto which carrier bars are affixed, as is represented in figure 2. The rotational axis C of the disc runs parallel to the direction of the carriers bars 18. In this manner, by rotating the disc 20, it is possible to preposition the selected sleeves 12, 15 into the favorable position for sliding onto the rollers. Also arranged on this disc is respectively one bar 18 carrying an anilox roller sleeve and respectively one bar carrying a printing roller sleeve, spaced apart in such a manner, that both of the aforementioned carrier bars can be simultaneously brought into a position of alignment together with the two rollers 13, 16 of an inking unit. The advantage of such a type of magazine construction as compared to the type of construction shown in FIGS. 6 and 7 consists therein that during the changing of sleeves, no alteration of the position of the entire magazine 17 is required relative to the printing machine 1, which would bring the carrier bars charged with the sleeves of the executed job order out of aligned position with the rollers. This process is effected by a simple rotation of the disc, which is carried out by the motor 27 and by the torque transfer cylinder 28. At the end of the rotation of the cylinder, the carrier bars with the "new" sleeves 15, 12 align with the axes of the rollers 17, 16.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| Reference number list | |
|---|---|
| 1 | Printing machine |
| 2 | Side stand [frame] |
| 3 | Platform |
| 4 | Support |
| 5 | Steps |
| 6 | Footboard |
| 7 | Safety railing |
| 8 | Step railing |
| 9 | Cutout in side stand |
| 10 | Counter-pressure cylinder |
| 11 | Bearing block for anilox roller |
| 12 | Anilox roller sleeve |
| 13 | Anilox roller |
| 14 | Bearing block for printing roller |
| 15 | Printing roller sleeve |
| 16 | Printing roller |
| 17 | Magazine for sleeves |
| 18 | Carrier bar |
| 19 | Hoist |
| 20 | Rotatable disc |
| 21 | Runway rail |
| 22 | Elbow |
| 23 | Underprop bearing for anilox roller |
| 24 | Underprop bearing for printing roller |
| 25 | Inking unit |
| 26 | Inking unit |

-continued

| Reference number list | |
|---|---|
| 27 | Motor for rotating the disc 20 |
| 28 | Cylinder for transfer of torque |
| 29 | Insert for extending loading surface of the take-up device |
| 30 | Free end of the rollers or of their shafts |
| 31 | Free end of the inserts 29 |
| 32 | Case |
| 33 | Operating personnel |
| C | Rotational axis of the disc |

What is claimed is:

1. A changing station for sleeves of a printing machine, comprising:

a magazine having at least one take-up device for cooperating with the sleeves;

a mechanism for conveying the magazine vertically alongside the printing machine;

a mechanism for conveying the magazine horizontally alongside the printing machine in a direction perpendicular to an axis of a roller of the printing machine; and a mechanism for changing a position of the take-up device within the magazine.

2. The changing station according to claim 1, wherein the mechanism for conveying the magazine vertically is a crane.

3. The changing station according to claim 1, wherein the mechanism for changing the position of the take-up device is a disc that circulates around an interior of the magazine and against which the take-up device is supported.

4. The changing station according to claim 1, wherein the mechanism for changing the position of the take-up device is a shelf or shaft system, in which at least one carriage is movable, and from which the take-up device is suspended.

5. The changing station according to claim 1, wherein the magazine has a plurality of take-up devices, of which at least two can sequentially assume a same position.

6. The changing station according to claim 1, wherein the magazine has at least two take-up devices, and the two take-up devices have a same spacing distance from one another as do axes of printing roller sleeves and anilox roller sleeves that are changed.

7. The changing station according to claim 1, wherein a spacing distance between a free end of the take-up device and a free end of a printing roller shaft or of an anilox roller shaft is less than an axial length of the sleeve.

8. The changing station according to claim 1, wherein the take-up device has inserts that can be withdrawn therefrom and that extend a loading surface of the take-up device in a direction of a free end of printing rollers that hold the sleeves.

9. The changing station according to claim 1, wherein the mechanism for conveying the magazine horizontally is a rail.

* * * * *